US008179046B2

(12) United States Patent
Borsuk et al.

(10) Patent No.: US 8,179,046 B2
(45) Date of Patent: May 15, 2012

(54) ULTRAVIOLET LAMP SYSTEM WITH COOLING AIR FILTER

(75) Inventors: James M. Borsuk, Westlake, OH (US); Edward C. McGhee, Amherst, OH (US)

(73) Assignee: Nordson Corporation, Westlake, OH (US)

( * ) Notice: Subject to any disclaimer, the term of this patent is extended or adjusted under 35 U.S.C. 154(b) by 407 days.

(21) Appl. No.: 12/123,643

(22) Filed: May 20, 2008

(65) Prior Publication Data

US 2009/0289552 A1 Nov. 26, 2009

(51) Int. Cl.
*H01J 19/80* (2006.01)

(52) U.S. Cl. ..... 315/39; 315/112; 315/248

(58) Field of Classification Search ..... 315/39, 315/56, 112, 248; 250/492.1, 492.2, 492.3, 250/493.1, 504 R, 503.1; 362/263, 264, 362/294, 311

See application file for complete search history.

(56) References Cited

U.S. PATENT DOCUMENTS

| | | | | |
|---|---|---|---|---|
| 4,498,029 | A * | 2/1985 | Yoshizawa et al. | 315/39 |
| 4,504,768 | A * | 3/1985 | Ury et al. | 315/248 |
| 4,990,789 | A * | 2/1991 | Uesaki | 250/504 R |
| 5,666,640 | A * | 9/1997 | Daniylchev | 422/186.1 |
| 5,998,934 | A * | 12/1999 | Mimasu et al. | 315/118 |
| 6,323,601 | B1 * | 11/2001 | Klein et al. | 315/248 |
| 6,621,087 | B1 * | 9/2003 | Bisges et al. | 250/492.1 |
| 6,680,576 | B2 * | 1/2004 | Jeon | 315/112 |
| 6,831,419 | B1 | 12/2004 | Schmitkons et al. | |
| 2003/0038247 | A1 * | 2/2003 | Schweitzer et al. | 250/455.11 |
| 2004/0239256 | A1 * | 12/2004 | Schmitkons et al. | 315/112 |
| 2005/0178984 | A1 * | 8/2005 | Brickley | 250/504 R |

* cited by examiner

*Primary Examiner* — Tung X Le

(74) *Attorney, Agent, or Firm* — Wood, Herron & Evans, L.L.P.

(57) ABSTRACT

A microwave-excited ultraviolet lamp system includes a microwave chamber cooled with air drawn through the chamber by a negative pressure source. A filter provided at an inlet of the lamp system prevents particulate material from entering the microwave chamber.

11 Claims, 3 Drawing Sheets

ULTRAVIOLET LAMP SYSTEM WITH COOLING AIR FILTER

TECHNICAL FIELD

The present invention relates generally to microwave-excited ultraviolet lamp systems, and more particularly to an ultraviolet lamp system having a cooling air filter.

BACKGROUND

Ultraviolet lamp systems, such as those used in the heating or curing of adhesives, sealants, inks or other coatings for example, are designed to couple microwave energy to an electrodeless lamp, such as an ultraviolet (UV) plasma lamp bulb mounted within a microwave chamber of the lamp system. In ultraviolet lamp heating and curing applications, one or more magnetrons are typically provided in the lamp system to couple microwave radiation to the plasma lamp bulb within the microwave chamber. The magnetrons are coupled to the microwave chamber through waveguides that include output ports connected to an upper end of the chamber. When the plasma lamp bulb is sufficiently excited by the microwave energy, it emits ultraviolet radiation through an open lamp face of the lamp system to irradiate a substrate which is located generally near the open lamp face.

A source of forced air is fluidly connected to a housing of the lamp system which contains the magnetrons, the microwave chamber and the plasma lamp bulb. The source of forced air is operable to direct cooling air, such as 350 CFM of cooling air for example, through the housing and into the microwave chamber to properly cool the magnetrons and the plasma lamp bulb during irradiation of the substrate by the lamp system. The cooling air may be exhausted through an outlet of the housing.

In some UV heating and curing applications, the lamp system includes a mesh screen mounted at the open lamp face. The screen is transmissive to ultraviolet radiation but is opaque to microwaves. The configuration of the mesh screen also permits the significant airflow of cooling air to pass therethrough and toward the substrate.

In other applications, the substrates irradiated by the UV lamp may require a clean environment, such as in a curing chamber, so that the substrate will not be contaminated during the drying and curing process by contaminants that may be carried by the cooling air. The substrate may also be somewhat delicate and may therefore be susceptible to damage by significant flow of cooling air that would impinge upon and possibly disturb the substrate. In other applications, the substrate may also be adversely affected by excessive heat which may be generated by the plasma lamp bulb during the irradiation process. In such applications, a quartz lens has been used to protect the substrate from the flow of cooling air, while facilitating irradiation of the substrate by the lamp. Such a system is described in U.S. Pat. No. 6,831,419 to Schmitkons et al., the disclosure of which is incorporated by reference herein in its entirety.

In conventional microwave-excited UV lamp systems, cooling air is provided from a source, such as a blower, fan or other appropriate air-moving device communicating with an inlet to the housing, and is supplied at a predetermined flow rate, such as about 350 CFM. The lamp system may also include a pressure source associated with an outlet of the housing, to remove excessive heat and ozone generated during operation of the lamp system. The lamp system may further include a pressure switch positioned in the air stream to ensure that an adequate flow of air is provided to cool the magnetrons and the ultraviolet lamp. In such systems, the pressure switch may shut down the UV lamp system to avoid overheating when an insufficient amount of airflow is detected.

In certain applications, it is desired to adjust the power of a UV lamp system to obtain particular results, or to place the system in a "stand-by" mode. Over cooling of the UV lamp may result when the power is reduced due to the constant flow of cooling air across the lamp, which has generally been set to correspond to a particular power level of the lamp. Additive-type UV bulbs generally require temperatures that are close to the maximum allowable temperature of the bulb to ensure that the additive materials remain in the plasma and thereby produce the desired spectrum. When these additive-type systems are operated at reduced power, the bulbs can become overcooled such that the additives are not maintained in the plasma, thereby resulting in decreased efficiencies and/or undesirable results. Likewise, if there is insufficient cooling, the system may overheat, affecting the operation of the magnetrons and lamp as discussed above, and resulting in decreased efficiencies and/or undesirable results.

Proper cooling of the lamp system may be further complicated when filters are added to protect the substrate from contaminants. A need exists for a UV lamp system that addresses these and other drawbacks of the prior art.

SUMMARY

A microwave-excited UV lamp system in accordance with the present disclosure includes a housing with a microwave chamber. Cooling air is drawn into the housing through an inlet by a negative pressure source provided at an outlet of the housing. The cooling air flows through the housing and is directed to the microwave chamber to cool the UV lamp. A filter coupled to the inlet filters the cooling air, thereby preventing particulate material from entering the housing.

In another aspect of the invention, a method of operating a microwave-excited UV lamp system includes emitting ultraviolet radiation from a lamp head, drawing cooling air into the lamp head using negative pressure, and filtering the cooling air as it enters the lamp head under the action of the negative pressure.

These and other features, advantages, and objectives of the invention will become more readily apparent to those of ordinary skill in the art upon review of the following detailed description of exemplary embodiments, taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION

Figure 1:
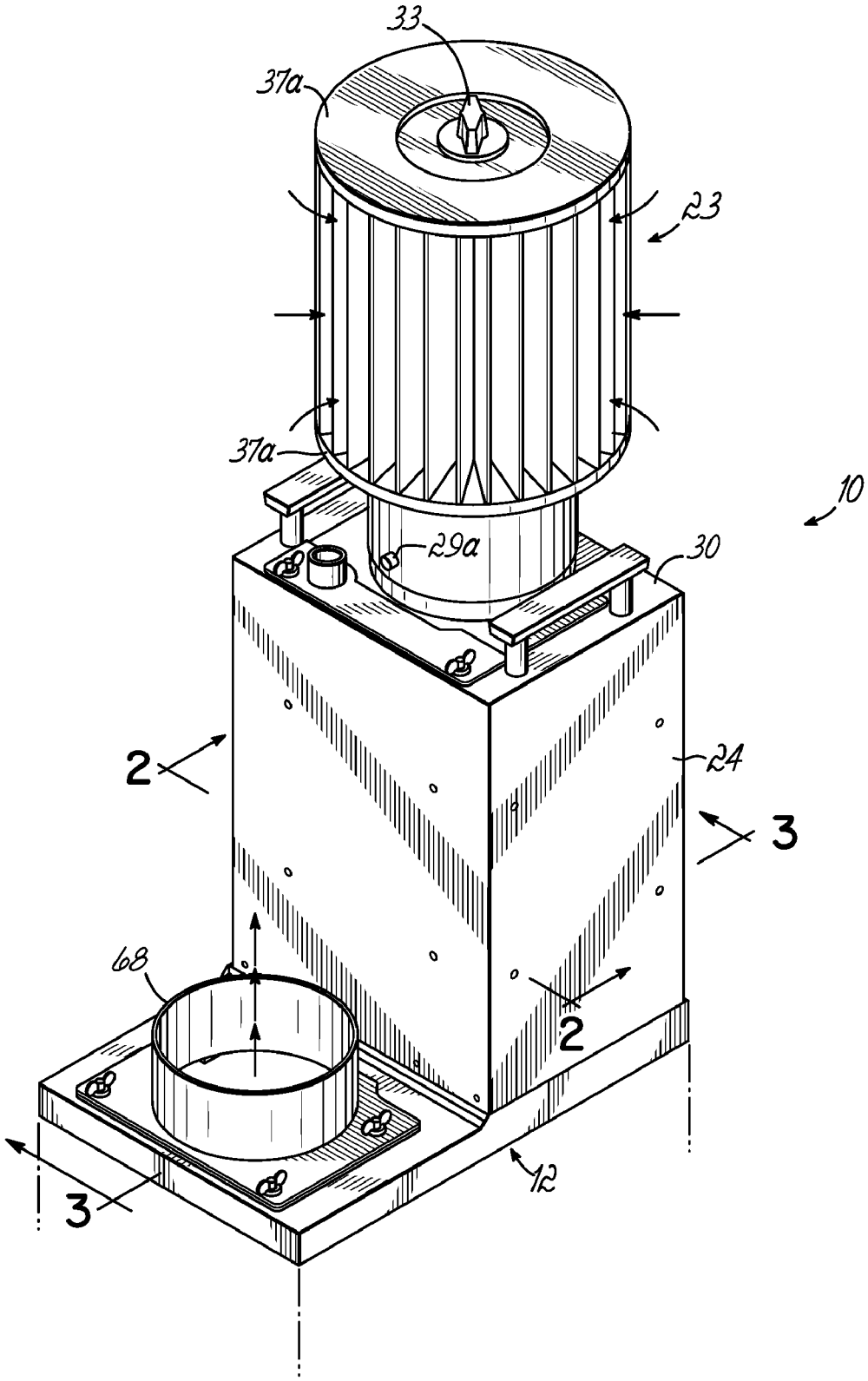
FIG. 1 is a perspective view of a microwave-excited ultraviolet lamp system, including an exhaust system and air filter, in accordance the principles of the present disclosure.
Figure 2:
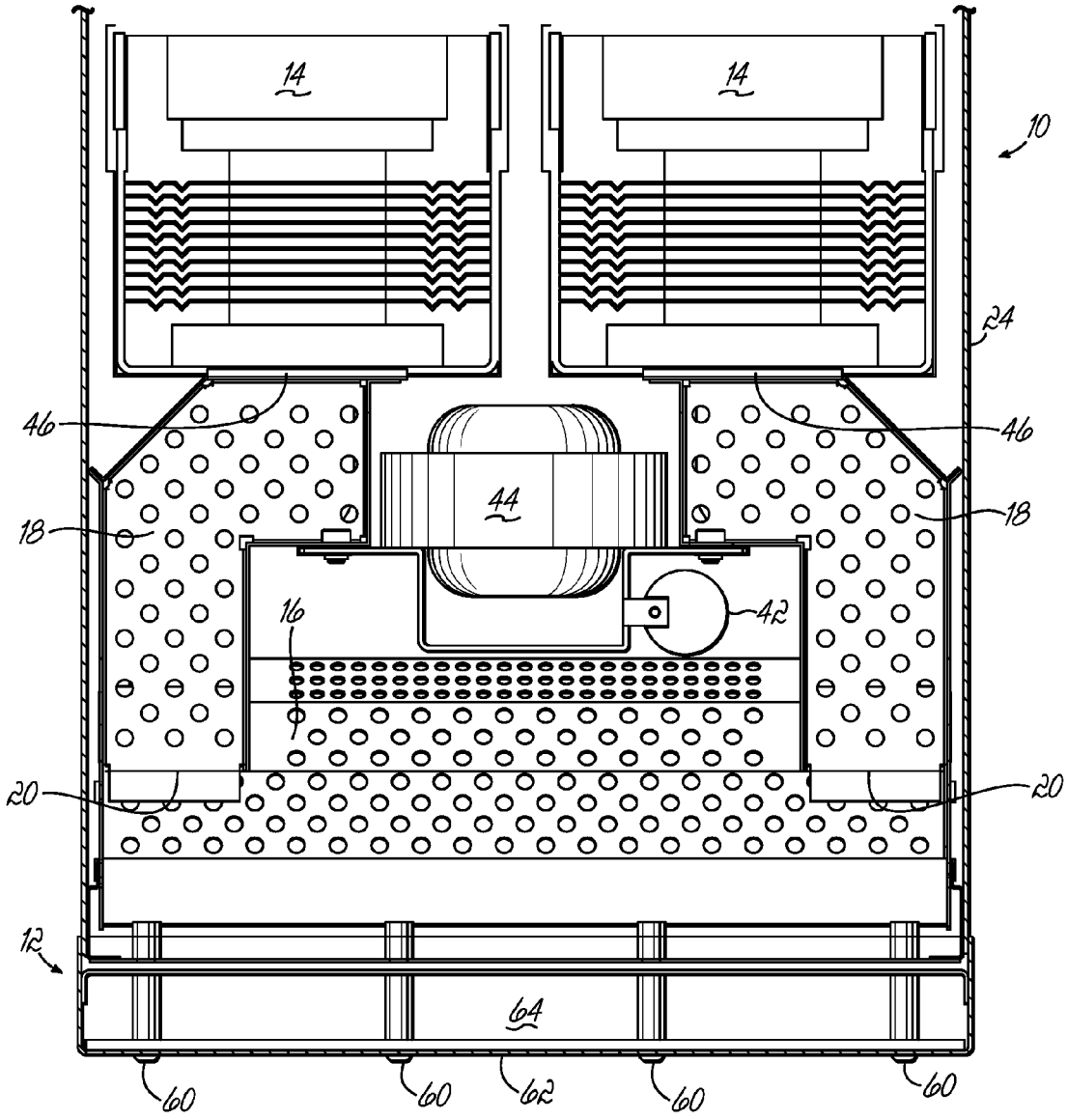
FIG. 2 is a cross-sectional view of the lamp system of FIG. 1, taken along line 2-2.
Figure 3:
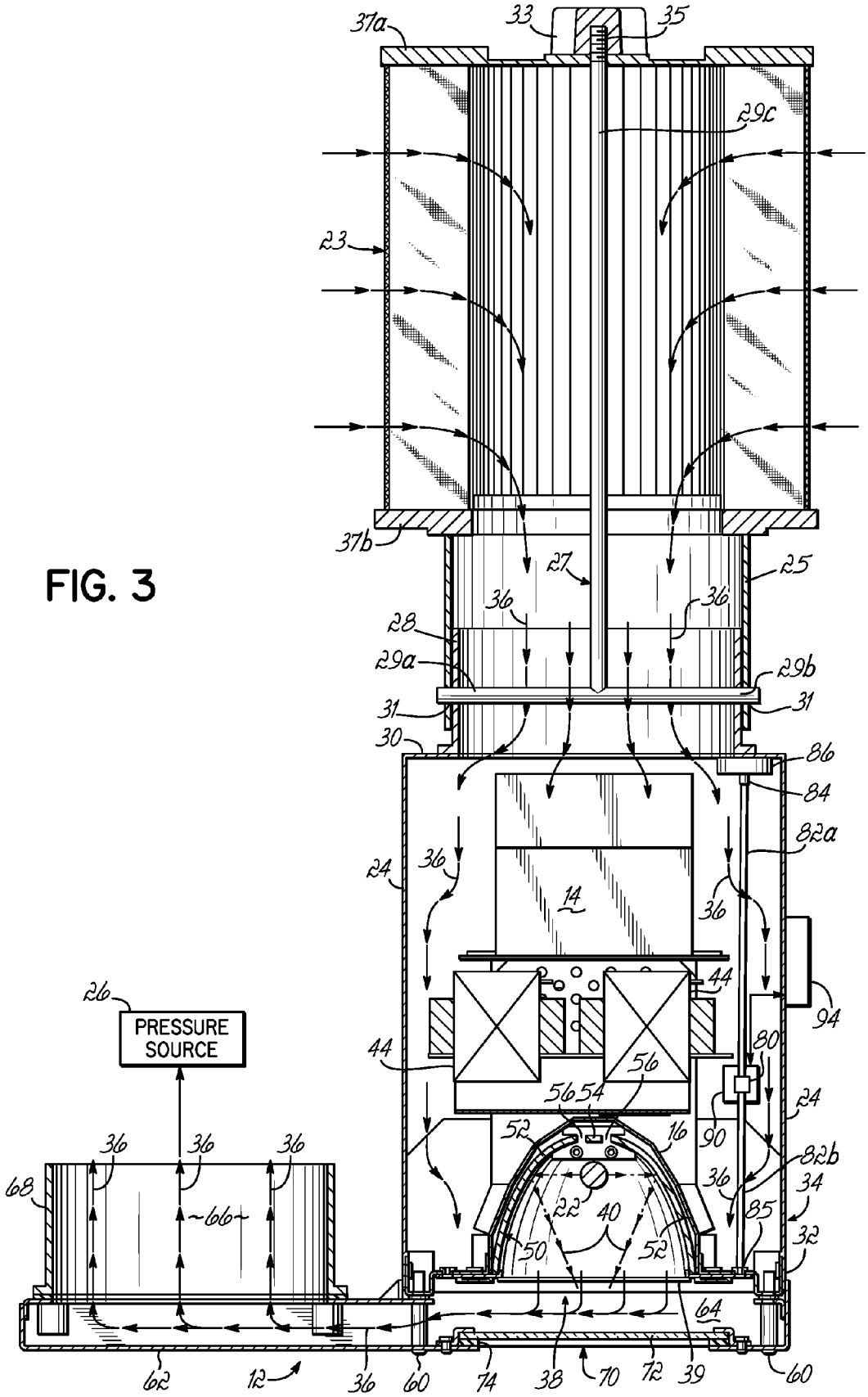
FIG. 3 is a cross-sectional view of the lamp system of FIG. 1, taken along line 3-3.

With reference to the FIGS. 1-3, a microwave-excited ultraviolet ("UV") lamp system 10 is shown, including an exhaust system 12 mounted thereto. Lamp system 10 includes a pair of microwave generators, illustrated as a pair of magnetrons 14 (FIGS. 2-3), that are each coupled to a longitudinally extending microwave chamber 16 through a respective waveguide 18 (FIG. 2).

Each waveguide 18 has an outlet port 20 (FIG. 2) coupled to an upper end of the microwave chamber 16 so that microwaves generated by the pair of microwave generators 14 are coupled to the microwave chamber 16 in spaced, longitudinal relationship adjacent opposite upper ends of the chamber 16. An electrodeless plasma lamp 22, in the form of a sealed, longitudinally extending plasma bulb, is mounted within the microwave chamber 16 and is supported adjacent the upper end of the chamber 16 as known in the art.

Lamp system 10 further includes a housing 24 that is connected in fluid communication with a negative pressure source 26 through an air exhaust duct 68 associated with the exhaust system 12. The lower end 32 of the housing 24 forms a lamp head 34 (FIG. 3). The negative pressure source 26 is operable to draw cooling air, represented diagrammatically in FIG. 3 by arrows 36, through an air inlet duct 28 located at an upper end of the housing 24 and into the microwave chamber 16 to cool the magnetrons 14 and plasma lamp bulb 22, as will be described in greater detail below. The negative pressure source may be a vacuum generator, a blower or fan adapted to draw air through exhaust duct 68, or any other device suitable for drawing cooling air through microwave chamber 16. The cooling air 36 passes through the microwave chamber 16 and is emitted through an open lamp face 38 (FIG. 3) of the lamp head 34.

The lamp system 10 may further include a filter 23 coupled to the air inlet duct 28 for filtering air drawn into the housing 24 by the negative pressure source 26 located near exhaust duct 68 of the exhaust system 12. The filter 23 prevents particulate matter from entering the housing 24 with the cooling air and thereby further prevents contamination of the substrate during operation of the lamp system 10. In the embodiment shown, filter 23 is a generally cylindrical cartridge filter, such as Craftsman Model Number 9-17804 available from Sears, Roebuck and Co., Hoffman Estates, Ill. While a generally cylindrical cartridge filter is shown herein, it will be appreciated that various other types of filters suitable for preventing particulate material from entering housing 24 may be used.

In the embodiment shown in FIG. 3, an adapter 25 is secured to air inlet duct 28 to facilitate sealing engagement of filter 23 with the housing 24. Filter 23 is further secured to air inlet duct 28 by a T-shaped mounting fixture 27 disposed within the air inlet duct 28 and having first and second arms 29*a*, 29*b* supported by apertures 31 provided on opposite sides of air inlet duct 28 and/or adapter 25. A third arm 29*c* of mounting fixture 27 extends upwardly through the center of filter 23 to receive a nut 33 on a threaded end 35 thereof. Nut 33 may be threadably secured to threaded end 35 to draw filter 23 firmly into sealing engagement with air inlet duct 28. In the embodiment shown, filter 23 includes upper and lower flange plates 37*a*, 37*b* that are clamped by the nut 33 and adapter 25, respectively. It will be appreciated, however, that filter 23 may be provided in various other configurations, and the structure of the housing 24, adapter 25, mounting assembly 27, and/or nut 33 may vary, as may be needed to sealingly secure filter 23 to air inlet duct 28.

The lamp head 34 may include a mesh screen 39 mounted over lamp face 38. The screen 39 is transparent to emitted ultraviolet radiation 40, but is opaque to microwaves generated by the magnetrons 14. Lamp system 10 is designed and constructed to emit ultraviolet light, illustrated diagrammatically in FIG. 3 by arrows 40, through the open lamp face 38 of the lamp system 10 upon sufficient excitation of the plasma lamp bulb 22 by microwave energy coupled to the microwave chamber 16 from the pair of microwave generators 14. While a pair of magnetrons 14 are illustrated and described herein, it is to be understood that the lamp system 10 may include only a single magnetron 14 to excite the plasma lamp bulb 22 without departing from the spirit and scope of the present invention.

As shown in FIG. 2, lamp system 10 includes a starter bulb 42 and a pair of transformers 44 (one shown in FIG. 2) that are each electrically coupled to a respective one of the magnetrons 14 to energize filaments of the magnetrons 14 as understood by those skilled in the art. The lamp system 10 may be adapted to permit adjustment of a power setting of the magnetrons 14 to vary the power output by the plasma lamp bulb 22. The magnetrons 14 are mounted to respective inlet ports 46 (FIG. 2) of the waveguides 18 so that microwaves generated by the magnetrons 14 are discharged into the chamber 16 through the longitudinally spaced apart outlet ports 20 of the waveguides 18. Preferably, the frequencies of the two magnetrons 14 are split or offset by a small amount to prevent intercoupling between them during operation of the lamp system 10.

A longitudinally extending reflector 50 is mounted within the microwave chamber 16 for reflecting the ultraviolet light 40 emitted from the plasma lamp bulb 22 toward a substrate (not shown) that is located generally near the open lamp face 38 of the lamp head 34. In one embodiment, reflector 50 has an elliptical configuration in transverse cross-section, although parabolic or other cross-sectional configurations are also possible.

As shown in FIG. 3, reflector 50 includes a pair of longitudinally extending reflector panels 52 that are mounted in opposing, i.e., mirror facing relationship, within the microwave chamber 16 and in spaced relationship to the plasma lamp bulb 22. Each reflector panel 52 may be made of coated glass or other materials having suitable reflective and thermal properties. When the reflector panels 52 are made of coated glass, for example, each reflector panel 52 is transparent to the microwave energy generated by the pair of magnetrons 14 but opaque to and reflective of the ultraviolet light 40 emitted by the plasma lamp bulb 22.

Further referring to FIG. 3, a longitudinally extending intermediate member 54 is mounted within the microwave chamber 16 in spaced relationship to the reflector panels 52, and also in spaced relationship to the plasma lamp bulb 22. The intermediate member 54 may be made of glass, such as PYREX®, and may be uncoated so that it is non-reflective of the ultraviolet light 40 emitted by the plasma lamp bulb 22.

When the pair of reflector panels 52 and the intermediate member 54 are mounted within the microwave chamber 16 to form the reflector 50, a pair of spaced, longitudinally extending slots 56 (FIG. 3) are formed between the reflector panels 52 and the intermediate member 54. The pair of spaced, longitudinally extending slots 56 are operable to pass cooling air 36 from inlet 28 toward the plasma lamp bulb 22 so that the cooling air 36 envelops the plasma lamp bulb 22 effectively entirely about its outer surface to cool the bulb 22. Details of the construction of the reflector 50 are more fully described in commonly owned U.S. Pat. No. 6,696,801, entitled "Microwave Excited Ultraviolet Lamp System With Improved Cooling", the disclosure of which is incorporated herein by reference in its entirety. Of course, other reflector configurations are possible as well as will be readily understood by those of ordinary skill in the art. The cooling air 36 thereafter passes through the microwave chamber 16 and is emitted through the open lamp face 38 of the lamp head 34.

As shown in FIGS. 1-3, the exhaust system 12 is mounted in fluid communication with the lamp head 34 so that cooling air 36 emitted from the open lamp face 38 is contained and directed within the exhaust system 12 so as not to contact the substrate (not shown) being irradiated. The exhaust system 12 is secured to the lower end 32 of the housing 24, for example by fasteners 60, and comprises an enclosed duct 62 having an air inlet port or plenum 64 (FIG. 3) configured to receive cooling air 36 drawn through the open lamp face 38, and an exhaust port 66 defined by exhaust duct 68 (FIG. 3) configured to direct the cooling air 36 to a location remote from the lamp head 34 so that the cooling air 36 does not contact the substrate (not shown).

As shown in FIGS. 1-3, air exhaust duct 68 is mounted to duct 62 generally in registry with the exhaust port 66. The exhaust duct 68 is fluidly connected to an air exhaust system (not shown) so that the cooling air 36 is contained and directed within the exhaust system 12 to an area where it will not contact and thereby possibly contaminate or disturb the substrate. While the exhaust system 12 has been depicted herein as having ductwork located beneath the open face 38 of the lamp head 34, with a generally vertically directed exhaust port 66, it will be appreciated that the configuration and orientation of the exhaust port 66 and the exhaust duct 68 may have various other configurations, as may be desired.

As shown in FIGS. 2 and 3, duct 62 has an opening 70 formed therethrough and positioned generally in registry with the microwave chamber 16. A lens 72, such as a quartz lens, is mounted to the duct 62 and is positioned generally in registry with the opening 70. The lens 72 transmits the ultraviolet light 40 emitted through the lamp face 38 toward the substrate. A gasket 74 (FIG. 3) is positioned between a lower surface of the lens 72 and a bottom wall of the duct 62, generally about the opening 70 to provide a generally air tight seal therebetween. The quartz lens 72 is beneficial to reduce heat transfer to the substrate from the plasma lamp bulb 22 and also serves as an air shield to prevent the cooling air 36 emitted from the lamp face 38 from contacting the substrate.

UV lamp system 10 further includes a pressure sensor 80 positioned to sense a pressure associated with the cooling air 36 drawn through housing 24. The sensed pressure is indicative of the flow rate of cooling air 36 through housing 24. In one embodiment, the pressure sensor 80 is a differential transducer configured to sense a difference in pressure between a location inside the lamp system 10 and atmospheric pressure. It will be recognized, however, that various other types of sensors adapted to sense a pressure associated with the flow of cooling air 36 may be used. In the embodiment shown in FIG. 3, differential pressure transducer 80 is mounted within the housing 24. A first sampling conduit 82*a* extends toward the upper end 30 of the housing 24 such that the upper end 84 of conduit 82*a* is exposed to the lamphead static pressure. In the embodiment shown, the upper end 84 of the conduit 82*a* is secured by a mounting fixture 86 adjacent the upper end 30 of the housing 24. A second sampling conduit 82*b* extends toward the lower end 32 of housing 24 and has a lower end 85 mounted adjacent to mesh screen 39 at the open face 38 of the lamp head 34. The pressure sensor 80 generates a signal related to the difference in pressure between the atmosphere and the cooling air flow inside housing 24 adjacent mesh screen 39. This differential pressure is related to the flow rate of the cooling air 36.

The lamp system 10 further includes a control 90 configured to govern operation of lamp system 10. The control 90 may receive signals from various sensors and/or other components of the lamp system 10, and is configured to coordinate the functions of the lamp system 10 based on the received signals. For example, the control 90 may receive signals related to the desired power setting for the lamp 22, whereby the control 90 is configured to adjust current supply to the transformers 44 to obtain the desired power output of the lamp 22. In the embodiment shown, the pressure sensor 80 communicates with the control 90 to provide a signal related to the sensed air pressure in plenum 64. The control 90 is further operatively coupled to the pressure source 26 and is configured to selectively adjust operation of the pressure source 26 to provide a desired flow rate of cooling air through inlet 28 to housing 24. The control 90 may be configured to adjust operation of the pressure source 26 such that the flow rate of cooling air is proportional to the sensed air pressure, or various other forms of control may be used to establish an adjusted flow rate of cooling air.

In another embodiment of the invention, a method of operating a microwave-excited ultraviolet lamp system 10 includes emitting ultraviolet radiation from a lamp head 34, drawing cooling air 36 into the lamp head 34 using a negative pressure source 26, and filtering the cooling air 36 as it enters the lamp head 34 under the action of the negative pressure source 26.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The various features described herein may be used alone or in any combination. The invention in its broader aspects is therefore not limited to the specific details, representative apparatus and method and illustrative examples shown and described. Accordingly, departures may be made from such details without departing from the scope or spirit of the general inventive concept.

What is claimed is:

1. A microwave-excited ultraviolet lamp system, comprising:

a housing;

a microwave chamber within said housing;

a microwave generator operatively coupled with said microwave chamber;

an inlet in fluid communication with said microwave chamber;

an outlet in fluid communication with said microwave chamber;

a pressure source only proximate said outlet and no pressure source at said inlet, said pressure source drawing cooling air into said microwave chamber through said inlet and exhausting cooling air through said outlet; and a filter coupled to said inlet for filtering cooling air drawn through said inlet.

2. The lamp system of claim 1, further comprising an ultraviolet bulb in said microwave chamber.

3. The lamp system of claim 1, wherein said filter comprises a mounting surface configured to sealingly engage said inlet.

4. The lamp system of claim 1, further comprising:

a wave guide configured to direct microwave radiation into said microwave chamber.

5. The lamp system of claim 1, wherein said inlet comprises an inlet duct coupled to an aperture in said housing, the lamp system further comprising:

an adapter disposed between said filter and said inlet duct and providing sealing engagement between said filter and said inlet duct.

6. The lamp system of claim 5, further comprising:

a fixture having a first end operatively coupled to said inlet duct and a second end operatively coupled to said filter;

said fixture clamping said filter against said adapter.

7. A microwave-excited ultraviolet lamp system, comprising:

a lamp head having an inlet for admitting cooling air, said lamp head terminating in a lamp face through which ultraviolet light and cooling air are emitted during ultraviolet radiation of a substrate by said lamp head;

a microwave generator operatively coupled with said lamp head;

an enclosed exhaust duct supported by said lamp head, said exhaust duct in fluid communication with said lamp face and having an air inlet port that receives the cooling air emitted through said lamp face, and having an outlet port that directs cooling air within said exhaust duct so as not to contact the substrate;

a filter operatively coupled to said lamp head inlet; and a pressure source operatively coupled only to said exhaust duct outlet port and no pressure source at said inlet, said pressure source drawing cooling air through said filter, through said lamp head inlet, and into said exhaust duct.

8. The lamp system of claim 7, further comprising:

a wave guide associated with said lamp head.

9. The lamp system of claim 7, wherein said lamp head inlet comprises an inlet duct, the lamp system further comprising:

an adapter disposed between said filter and said inlet duct and providing sealing engagement between said filter and said inlet duct.

10. The lamp system of claim 9, further comprising:

a fixture having a first end operatively coupled to said inlet duct and a second end operatively coupled to said filter;

said fixture clamping said filter against said adapter.

11. A method of operating a microwave-excited ultraviolet lamp system, comprising:

directing microwave energy into a microwave chamber having a lamp head therein;

emitting ultraviolet radiation from the lamp head;

drawing cooling air into the microwave chamber and lamp head using only negative pressure and no positive pressure source; and filtering the cooling air as it enters the lamp head under the action of the negative pressure.

* * * * *